United States Patent [19]

Schubert et al.

[11] Patent Number: 4,603,633

[45] Date of Patent: Aug. 5, 1986

[54] ARRANGEMENT FOR APPLICATION OF LIQUIDS, IN PARTICULAR COATING UNIT FOR A PRINTING PRESS

[75] Inventors: Johannes M. Schubert, Mainhausen; Gerhard Geuppert, Eppertshausen, both of Fed. Rep. of Germany

[73] Assignee: M.A.N.-Roland Druckmaschinen Aktiengesellschaft, Fed. Rep. of Germany

[21] Appl. No.: 760,286

[22] Filed: Jul. 29, 1985

[30] Foreign Application Priority Data

Jul. 28, 1984 [DE] Fed. Rep. of Germany ..... 3427898

[51] Int. Cl.[4] ..... B41F 31/02

[52] U.S. Cl. ..... 101/366; 101/364; 101/148; 118/261

[58] Field of Search ..... 101/366–367, 101/364, DIG. 26, 204, 210, 207–208, 148, 155, 157, 169; 118/261

[56] References Cited

U.S. PATENT DOCUMENTS

| | | | |
|---|---|---|---|
| 2,329,277 | 9/1943 | Lodding | 101/169 X |
| 2,887,050 | 5/1959 | Moser et al. | 101/364 |
| 2,983,222 | 5/1961 | Bakalars | 101/364 |
| 3,283,712 | 11/1966 | Chambon | 101/364 |
| 3,417,693 | 12/1968 | Hartka | 101/364 |
| 3,769,909 | 11/1973 | Fugman et al. | 101/148 |
| 4,165,688 | 8/1979 | Leanna et al. | 101/207 |
| 4,361,089 | 11/1982 | Witikopf et al. | 101/207 |
| 4,455,938 | 6/1984 | Loudon | 101/148 |

*Primary Examiner*—E. H. Eickholt

*Attorney, Agent, or Firm*—Leydig, Voit & Mayer, Ltd.

[57] ABSTRACT

An arrangement for application of liquids, such as a coating unit for a printing press, with a liquid supply above the metering gap formed between a metering roller and an applicator roller interacting therewith, a partition designed to damp vibrations dividing the liquid supply along the length of the rollers in order to compensate for turbulence, resonance and irregular air occlusions as far as the metering gap and to prepare uniform quantities of liquid. For this purpose baffle plates at right angles to the rollers have edges adapted to conform to the curvature of the roller surfaces to define a communicating gap with the roller surfaces, said baffle plates being arranged in a fixed position just inboard of the ends of the two rollers and formed as a unit with the partition defining a constant communicating gap with applicator roller, the partition having regularly arranged communicating channels in the form of holes, preferably a first row near the continuous bottom edge and a second row above the first one.

5 Claims, 3 Drawing Figures

ARRANGEMENT FOR APPLICATION OF LIQUIDS, IN PARTICULAR COATING UNIT FOR A PRINTING PRESS

FIELD OF THE INVENTION

The present invention relates generally to an arrangement for application of liquids, such as a coating unit for a printing press for printing and final varnishing of sheets and more particularly concerns such a unit with a liquid supply above the gap formed between a metering roller and a further roller interacting therewith and having a partition designed to damp vibrations dividing the liquid supply along the length of the rollers.

BACKGROUND OF THE INVENTION

To prevent turbulence and resonance, in an arrangement for application of liquids such as in an inking unit for a printing press with a liquid supply above the gap formed between a wiping roller and an applicator roller interacting therewith, it is known to immerse a flexible blade along the length of the two rollers in such a way that it rests tangentially on the applicator roller with its immersed end dividing the liquid supply into two unequal partial quantities. Such an arrangement is shown generally in DE-AS No. 1,561,116. In coating units of this type, which can also be combined with a perfecting unit such as shown in DE-PS No. 3,248,232, turbulence and resonance likewise occur in the coating supply according to the construction of the two-roller varnishing unit and corresponding to the diameters in the application of aqueous dispersion coating at higher speeds. However, the development of irregular air occulsions leads to more or less foamed areas at the metering gap, with the result that streakiness is produced on the coating applicator roller in the circumferential direction. The consequence is non-uniform coating application, so that streaks are visible in the printing material. Since the flexible blade rests tangentially on a roller, the communication possibilities between the partial quantities are inadequate and the vibration damping is effected only on the surface. Therefore, it cannot be used to damp different varnish quantities as far as the metering gap and simultaneously prepare uniform coating quantities.

In further efforts to prevent turbulence and resonance, it is also known how to provide an inking unit such as shown in DE-GM No. 1,707,927, in which the liquid or ink comes into contact with only one roller at the transfer point with a partition dividing the ink fountain in the longitudinal direction which forms a specific communicating gap with the bottom of the ink fountain and along the fountain roller. Consequently the turbulence formation is restricted to the smaller ink quantity occurring directly at the roller, but no measures are being taken to prevent or damp the turbulence of this part of the liquid. It is, however, important to damp precisely this part of the liquid that is in direct contact with the roller.

Inking units of different types with side walls at right angles to the axis of the rollers, which can be placed against the ink fountain roller with an end surface adapted to the curvature of the ink fountain roller shell, are also already known. The side walls do not bear any relationship to measures relating to the varnishing difficulties described above. This likewise applies to damping units of comparable design, which are provided with plates at the ends of the two damping rollers for lateral sealing of the liquid supply such as described in U.S. Pat. No. 3,404,625.

OBJECTIONS AND SUMMARY OF THE INVENTION

The primary aim of the present invention is to provide an arrangement of the above-mentioned type, which reliably equalizes turbulence and resonance at the metering gap as well as associated irregular air occlusions in the liquid in the wedge between a metering roller and a further roller, particularly the aqueous dispersion varnish in a printing press in order to prepare uniform varnish quantities thereby ensuring uniform application to the area to be wetted on the coating cylinder.

According to the invention, an arrangement for application of liquids, such as a coating unit for a printing press is provided, with a liquid supply above the metering gap formed between a metering roller and an applicator roller interacting therewith, a partition designed to damp vibrations dividing the liquid supply along the length of the rollers in order to compensate for turbulence, resonance and irregular air occlusions as far as the metering gap and to prepare uniform quantities of liquid. For this purpose baffle plates at right angles to the rollers have edges adapted to conform to the curvature of the roller surfaces to define a communicating gap with the roller surfaces, said baffle plates being arranged in a fixed position just inboard of the ends of the two rollers and formed as a unit with the partition defining a constant communicating gap with the applicator roller, the partition having regularly arranged communicating channels in the form of holes, preferably a first row near the continuous bottom edge and a second row above the first one.

With the refinement according to the invention stabilization of the liquid, in particular the aqueous dispersion coating in varnishing units for a printing press for printing and final coating of sheets, which can also be combined with a perfecting unit, is achieved by the fact that the partial quantities of liquid formed according to the invention can communicate with each other and with the environment according to the existing flow cross-sections with damping of vibrations, free of resonance and with equalization of the air occlusions even at higher speeds and with different diameters of the metering roller and a further roller.

These and other features and advantages of the invention will be more readily apparent upon reading the following description of a preferred exemplified embodiment of the invention and upon reference to the accompanying drawings wherein:

While the invention will be described in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
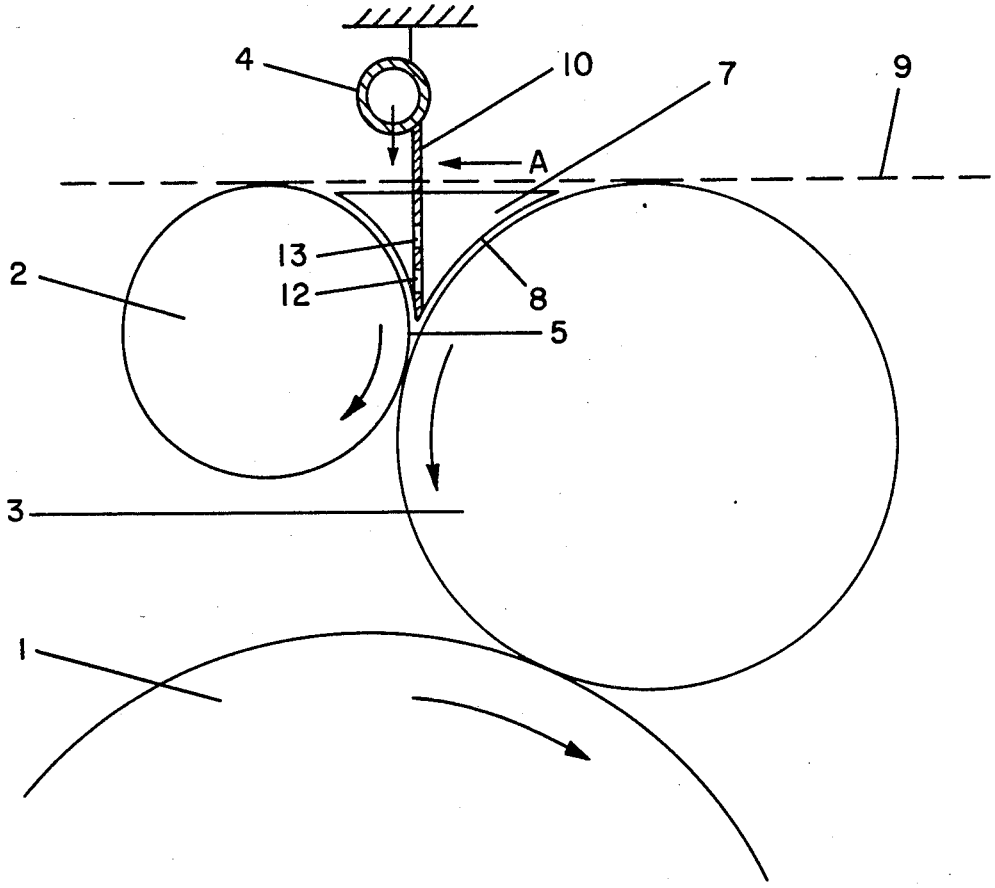
FIG. 1 is a schematic representation of a partial cross-sectional view of a coating arrangement according to the present invention.
Figure 2:
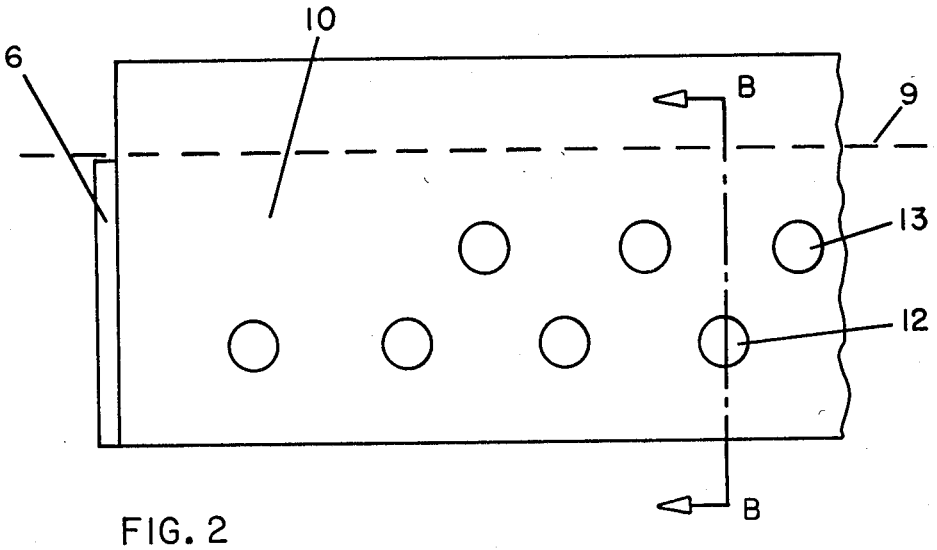
FIG. 2 is an enlarged, fragmentary detail in view A as shown in FIG. 1.
Figure 3:
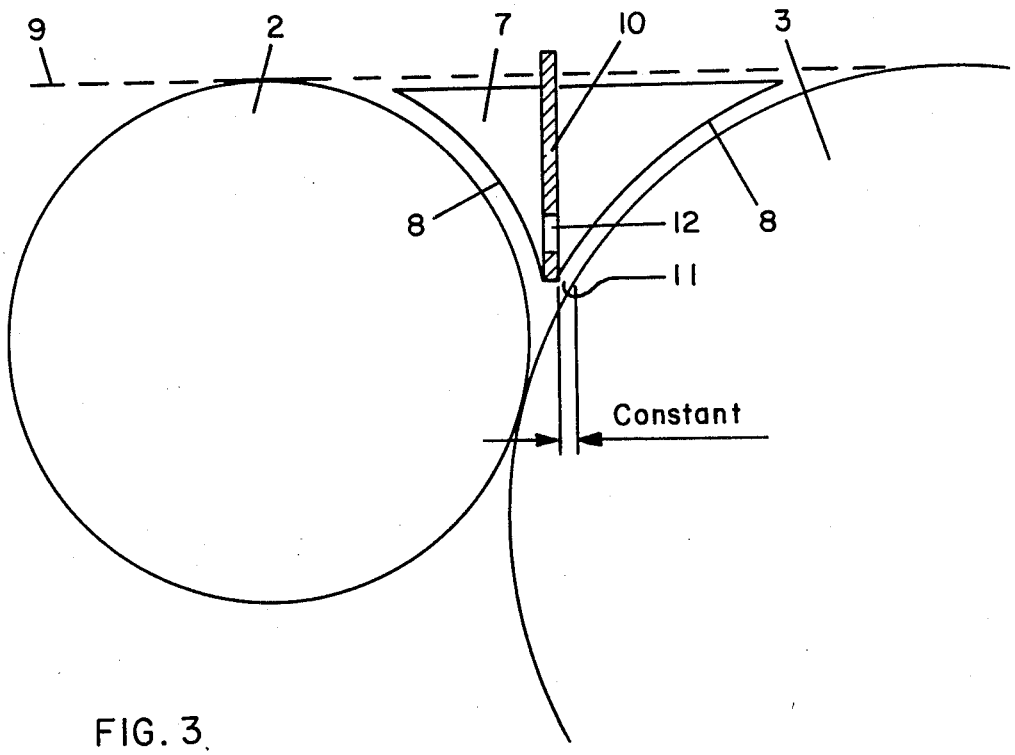
FIG. 3 is an enlarged fragmentary detail taken substantially along section B—B in FIG. 2.

In the preferred form of the invention, an arrangement for application of liquids such as a coating unit is provided for a printing press (not shown) for printing both sides of sheets and final varnishing on one side. The perfecting in this arrangement takes place at the same time as the coating. The top or plate cylinder 1 in the coating unit according to this arrangement, with a perfecting unit, is covered by a rubber blanket. As shown in FIG. 1, the two-roller coating unit consists of a coating metering roller 2 and a coating applicator roller 3 that supplies the plate cylinder 1 with an aqueous dispersion varnish, which is transferred directly to the printing material. The back pressure cylinder (not illustrated) is likewise covered by a rubber blanket and is located below the plate cylinder 1. Since it also serves as transfer cylinder for the image of the perfecting unit, this cylinder performs a dual function. It will be understood that the plate cylinder 1 also acts as back pressure cylinder for the perfecting. The coating is supplied via a feed pipe 4 to the gap 5 between the coating metering roller 2 and the coating applicator roller 3 and the excess quantity returned by pumps. The speed of the coating metering roller 2 can be varied via a potentiometer control to regulate the layer thickenss of the coating to be applied.

According to the present invention, baffle plates 6 and 7, each resembling an inverted triangle are provided in the coating supply formed above the gap 5 just inboard of the ends of the coating metering roller 2 and coating applicator roller 3. The two sides of this triangle facing downward are curved and follow the general contours of the surfaces of the coating metering roller 2 and the coating applicator roller 3, which differ because of their different diameters. The curved sides are located a very short distance from the roller surfaces so as to define a communicating gap 8 therebetween with the result that the coating accumulates in the gap 5 between the rollers 2 and 3.

The upper or base side of the triangular baffle plates 6, 7 determines the height of the accumulated varnish wedge. It is related to an imaginary horizontal plane 9 formed by the top edges of the coating metering roller 2 and coating applicator roller 3. To achieve an approximately identical higher varnish level over the entire machine width, coating outlet openings are provided in the feed pipe 4 along the full length of the rollers to a point near the ends of the rollers.

In further accordance with the invention, the two baffle plates 6, 7 are connected by a longitudinal partition 10 dividing the liquid supply. The lower edge of the partition 10 forms a further communicating gap 11 with the coating applicator roller 3. The bottom edge of the partition 10 is continuous and should not be more than about 3 to 4 mm from the coating applicator roller 3. Along the bottom edge, the partition 10 is perforated by a first row of regularly arranged communicating channels 12 and a second row of regularly arranged channels 13 above the first row. The communicating channels 12 form uniform liquid zones and their position, shape and size are adapted according to the invention to the liquid or coating to be applied to damp the vibrations. If the communicating channels 12 are designed as holes, the diameter is preferably 9.75 mm, the distance between the holes 20 mm, the distance of the first row of the bottom edge of the partition 10 about 18 mm and the distance of the second row from the bottom edge about 42 mm, for example, if liquids with a viscosity corresponding to the water-based dispersion coating normally used for in-line coating are to be applied.

The channels 13 effect faster transfer of coating from the side of the coating supply at the coating metering roller 2 to the side of the main transfer of coating at the coating applicator roller 3. The arrangement is held by a carrier, preferably the feed pipe 4, in a fixed position within the liquid supply. The feed pipe 4 should not immerse in the liquid supply forming via the gap between the rollers even at the highest coating level. According to the invention, the difficulties described above in connection with the prior art are eliminated by the communication of liquid on all sides and vibration damping in the liquid supply accumulated at a higher level, so that the coating unit with perfecting unit operates reliably even at higher speeds. The partition 10 can be secured adjustably in relation to the coating applicator roller 3 in the baffles 6, 7 for control of the metering at the communicating gap 11.

We claim as our invention:

1. In an arrangement for application of liquids, such as a coating unit for a printing press for the printing and final coating of sheets including a liquid supply above the gap formed between a metering roller and an applicator roller interacting therewith, the coating preferably being delivered uniformly by a feed pipe from several openings, with a partition designed to damp vibrations dividing the liquid supply along the length of the rollers, characterized by baffle plates at right angles to the rollers and having edges adapted to conform to the curvature of the roller surfaces to define a communicating gap with the roller surface, said baffle plates being arranged in a fixed position just inboard of the ends of the rolls, and interconnected by a partition having a continuous bottom edge defining a constant communicating gap with the applicator roller, the partition having regularly arranged communicating channels formed therein.

2. An arrangement according to claim 1 in which the partition has a first row of communicating channels in the form of holes near the continuous bottom edge and a second row of channels above the first row.

3. An arrangement according to claim 1 in which the baffle plates are formed as a one piece unit with the partition and the feed pipe.

4. An arrangement according to claim 1 in which the partition is secured to the baffle plates so as to be adjustable in relation to the applicator roller.

5. An arrangement according to claim 1 in which outlet openings are provided in the feed pipe along the entire length of the rollers to a point near the ends thereof.

* * * * *